United States Patent [19]

Baker et al.

[11] 4,306,612

[45] Dec. 22, 1981

[54] FIBER OPTIC SENSING DEVICE

[75] Inventors: Roderick J. Baker, Belmont; Ronald W. Wilson; Ronald N. Wightman, both of Wellsville, all of N.Y.

[73] Assignee: The Air Preheater Company, Inc., Wellsville, N.Y.

[21] Appl. No.: 92,809

[22] Filed: Nov. 9, 1979

[51] Int. Cl.[3] ..... F28D 19/00

[52] U.S. Cl. ..... 165/9

[58] Field of Search ..... 165/9, 7, 5

[56] References Cited

U.S. PATENT DOCUMENTS

| | | | |
|---|---|---|---|
| 3,246,686 | 4/1966 | Kalbfleisch et al. | 165/9 |
| 4,019,567 | 4/1977 | Wixson et al. | 165/5 |
| 4,058,158 | 11/1977 | Blom et al. | 165/9 |
| 4,124,063 | 11/1978 | Stockman | 165/9 |

*Primary Examiner*—Albert W. Davis

*Attorney, Agent, or Firm*—Wayne H. Lang

[57] ABSTRACT

A rotary regenerative heat exchange device has a rotor of heat absorbent element 19 that is exposed alternately to hot and cold fluid in order that heat from the hot fluid may be transferred to the cold fluid. The rotor is surrounded by a housing 22 including a sector plate 42 at opposite ends of the rotor that separates the hot from the cold fluid. The sector plate is forced to correspond to thermal distortion of the rotor to preclude fluid leakage therebetween. A unique fiber optic sensing device 58 utilizes a beam of infrared rays that detects excess clearance space between the rotor and the adjacent sector plate to actuate means that provides suitable corrective measures.

5 Claims, 2 Drawing Figures

FIBER OPTIC SENSING DEVICE

BACKGROUND OF THE INVENTION

In rotary regenerative heat exchange apparatus a mass of heat absorbent material commonly comprised of packed element plates is first positioned in a hot gas passageway to absorb heat from hot gases passing therethrough. After the plates become heated by the hot gases they are moved to a passageway for air or other cool fluid where the then hot plates transmit their absorbed heat to the fluid passing therethrough.

The heat absorbent material is carried in a rotor that rotates between hot and cool fluids, while a fixed housing including sector plates at opposite ends of the rotor is adapted to enclose the rotor. To prevent mingling of the hot and cold fluids, the end edges of the rotor are provided with flexible sealing members that rub against the adjacent surfaces of the rotor housing to accommodate a limited amount of rotor "turndown" or other misalignment caused by mechanical loading or thermal deformation of the rotor and the rotor housing.

To permit turning the rotor freely about its axis, certain minimum clearance space between the rotor and adjacent rotor housing is desired, however, excessive clearance is to be avoided because it will dictate excessive fluid leakage. Sealing means that compensate for the opening of space between the rotor and rotor housing are provided by U.S. Pat. Nos. 3,786,868 and 4,124,063. In these patents the sector plate is moved to what is believed to be an optimum position adjacent the end of the rotor so there will be a minimum of leakage between the sector plate and the adjacent rotor. Although such an arrangement is theoretically desirable, an effective way of rapidly sensing the precise movement desired by the sealing means or sector plate has not been developed so that corrective measures may be effected.

SUMMARY OF THE INVENTION

In accordance with our invention, we therefore propose to provide unique electronic means that utilizes fiber optic cables to project beams of infrared rays across the edge of an adjacent rotor. Interference of the rotor with these beams provides a signal that produces a corrective movement to the sealing means adjacent thereto.

DESCRIPTION OF THE PREFERRED EMBODIMENT

Figure 1:
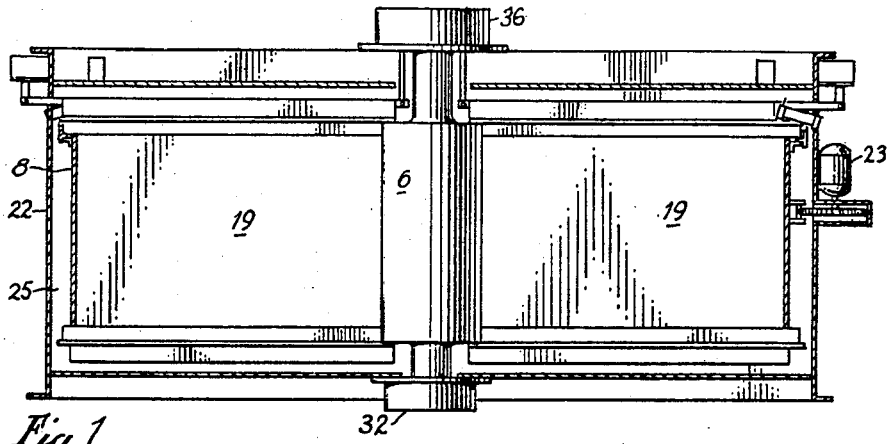
FIG. 1 is a cross-section of a rotary regenerative heat exchanger that involves the present invention.
Figure 2:
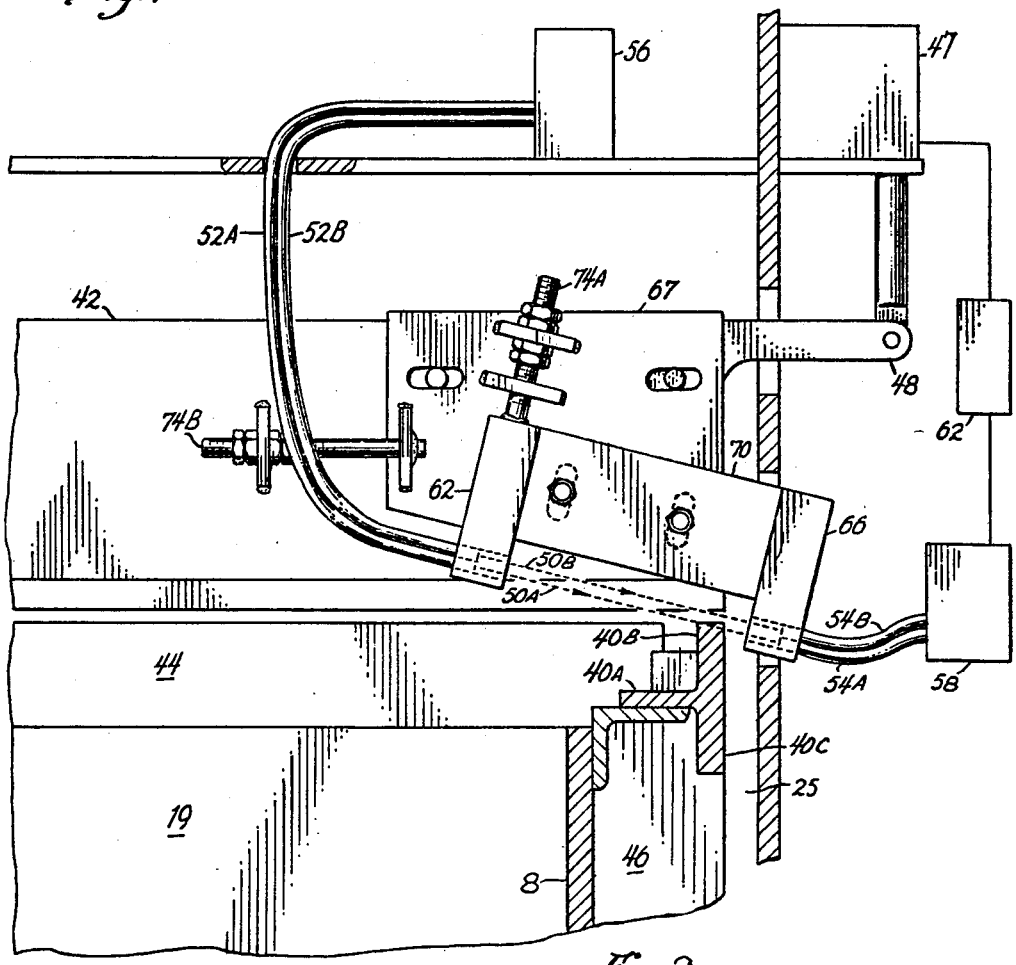
FIG. 2 is an enlarged side elevation that shows the details of the arrangement required to perform the claimed operation.

The heat exchanger includes a vertical rotor post 6 and a concentric shell 8 with an annular space therebetween that is filled with a mass of permeable heat absorbent material 19 in order that the heat absorbent material may be rotated slowly about its axis to a motor 23 whereby it will absorb heat from a heating fluid and transfer it to a fluid to be heated. A series of radially formed partitions or diaphragms between the rotor post 6 and the rotor shell 8 separate the rotor into a series of sector shaped compartments that carry the heat absorbent material 19.

The hot gas or other heating fluid enters the heat exchanger through an inlet duct and is discharged after traversing the cool heat exchange material carried by the rotor through a suitable outlet duct. Cool air or other gas to be heated enters the heat exchanger through a spaced inlet duct and is discharged as heated air after flowing over the heated material 19 and absorbing heat therefrom.

A cylindrical housing 22 encloses the rotor 8 in concentric relation to provide an annular space 25 therebetween. Sector plates 42 intermediate ends of the rotor and adjacent housing structure lie between spaced apertures that admit and discharge the streams of gas and air. In order that these streams of gas and air do not bypass the rotor, it is customary to affix radial sealing means 44 to the end edges of the rotor to confront adjacent surfaces of the rotor housing and to preclude fluid flow therebetween. Axial seals 46 are similarly affixed to the sides of the rotor and adapted to bridge the annular space 25 so that a minimum amount of fluid bypasses the rotor and the heat transfer element therein.

A lower support bearing 32 is mounted rigidly on independent support structure to support the central support shaft 6 for rotation about its vertical axis. As the rotor and its concentric shaft become heated, they expand axially through a guide bearing 36 and otherwise deform to cause rotor "turndown" in the manner defined extensively by U.S. Pat. No. 4,124,063.

Conventional sealing means respond to a physical opening of a clearance space or to relative movement between the rotor and its surrounding housing structure and are thus positive, effective actuators. However, such sealing means are slow to act inasmuch as corrective actuation of the seals usually depends upon movement of the rotor or rotor housing. Therefore, corrective measures may be effected only after a leakage path has occurred and has been sensed by mechanical sensing means. In the device of this invention, however, electric signals responsive to variations in a beam of infrared rays effect movement of a sealing means whereby correction is immediate. In fact, corrective movement of a body segment to close a leakage path between the rotor and surrounding housing structure frequently is made before any significant fluid leakage has occurred.

According to this invention an annular "T" bar 40 is secured to the end edge of the rotor that lies adjacent the inlet for the hot gas or other heating fluid. The "T" bar 40 includes a horizontal flange 40A that is secured to the rotor while flange 40B extends upward toward sector plate 42 and flange 40C extends axially down along the edge of axial seal 46. Radial seals 44 are attached to the radial diaphragms and are adapted to extend upward toward the sector plate 42 to seal off the space at the end of the rotor and to preclude fluid flow therebetween. Axial seals 46 extend axially down along the end edge of the rotor to reduce the clearance space between the rotor and the concentric housing to thus reduce the tendency toward radial flow of fluid around the rotor.

The sector plate 42 is a standard deformable sector plate constructed in accordance with U.S. Pat. No. 4,124,063 and adapted to be deformed an amount that makes it conform to the "turndown" of the adjacent rotor thereby there will be a minimum of fluid leakage therebetween.

The force required to deform the sector plate is provided by a motor drive assembly 47 mounted on the housing and connected to the outboard end of the sector plate 42 by a pivotal connection 48. The drive 47 is actuated by an electronic means that is sensitive to any movement of the rotor or sector plate that would alter the clearance space therebetween.

The electronic actuator for the motor drive unit 44 comprises essentially a pair of infrared beams 50A and 50B that are projected across a gap between ends of fiber optic transmitting cables 52A and 52B and fiber optic receiving cables 54A and 54B. The infra red beams are produced by a conventional transmitter 56, and they are received by a conventional receiver 58 that sends a corresponding signal to controller 62 that in turn actuates the motor drive 47 in response to the beams 50A and 50B.

The beams 50A and 50B are closely spaced and adapted to operate normally with the vertical edge of the "T" bar 40B adjusted to interrupt the lower beam 50A, while the upper beam remains intact whereby a signal may be continuously beamed from transmitter 56 to receiver 58 and controller 62. Thus, while an infrared beam is normally being projected through the transmitting cable 52B, beam 50B and receiving cable 54B to receiver 58, the end edge of the rotor ("T" bar flange 40B) normally interrupts the beam 50A being transmitted across the gap by fiber optic cable 52A so that no signal is being transmitted therethrough.

As the matrix of the rotor deforms downwardly, flange 40B moves out of the beam 50A between lower fiber optic cable 52A and receiving cable 54A, and a corresponding part of receiver 58 starts receiving a signal from transmitter 56. Upon receipt of the signal from transmitter 56 through fiber optic cable 52A, beam 50A and cable 54A, a signal is relayed to controller 62 so that it in turn may actuate the drive unit 47 to move the end of the sector plate 42 down to neutralize the leakage path formed by the downward movement of the rotor. If the rotor should deform upwardly whereby flange 40B would interrupt upper beam 50B, a signal would be sent from receiver to controller 58, and the controller 62 would reversely actuate motor drive 44 to drive the sector plate upwardly to thus retain the proper clearance space between the rotor and adjacent sector plate.

The ends of the fiber optic transmitting cables 52A and 52B are held by a fitting 62 that is secured to one end of a plate 70, while the opposite end of plate 70 carries another fitting 66 to which the ends of cables 54A and 54B are securely attached. The end faces of transmitting cables 52A and 52B are optically parallel to the end faces of transmitting cables 54A and 54B whereby the infrared rays being projected from the ends of the transmitting cables may be received by the corresponding receiving cables.

The plate 70 including the fittings 62 and 66 is vertically adjustable by an adjustment screw 74A on the side of a plate 67, while the plate 67 is movable horizontally by an adjustment screw 74B to impart to the beams 50A and 50B an oblique projection that intercepts end flange 40B of the rotor.

We claim:

1. Rotary regenerative heat exchange apparatus having a rotor including a central rotor post and a concentric rotor shell spaced therefrom to provide an annular space therebetween, a mass of heat absorbent material carried in the annular space between the rotor post and the rotor shell, a housing surrounding the rotor in spaced relation including inlet and outlet ducts at opposite ends for a heating fluid and for a fluid to be heated, bearing means adapted to support the rotor for rotation about its axis, means for rotating the rotor about its axis, means supporting the inboard end of the sector plate, actuating means at the outboard end of the sector plate adapted to drive the sector plate vertically into a sealing relationship with the adjacent edge of the rotor, said actuating means including a transmitter of infrared rays, fiber optic cable means connected to said transmitter including a transmitting end and a receiving end separated by a gap that brackets an end edge of the rotor, a receiver for infrared rays connected to the receiving end of the cable, and motor means responsive to a beam of infrared rays projected across said gap adapted to drive the sector plate into a sealing relationship with an adjacent end of said rotor.

2. Rotary regenerative heat exchange apparatus as defined in claim 1 including means secured to the sector plate holding the spaced transmitting and receiving ends of the fiber optic cable in optical alignment.

3. Rotary regenerative heat exchange apparatus as defined in claim 2 wherein the fiber optic cable means comprises parallel strands of independent fiber optic conductors.

4. Rotary regenerative heat exchange apparatus as defined in claim 3 including means for adjustably moving the holding means horizontally and vertically relative to the end edge of the rotor.

5. Rotary regenerative heat exchange apparatus as defined in claim 4 wherein the means supporting the fiber optic cable is secured obliquely to the sector plate to project a beam of infrared rays obliquely across an end edge of the rotor.

* * * * *